US012168977B2

(12) United States Patent
Stoessel

(10) Patent No.: US 12,168,977 B2
(45) Date of Patent: Dec. 17, 2024

(54) LIQUID PUMP, IN PARTICULAR FOR PROVIDING A SUPPLY TO A TRANSMISSION OF AN ELECTRIC OR HYBRID DRIVE MODULE OF A MOTOR VEHICLE

(71) Applicant: FTE automotive GmbH, Ebern (DE)

(72) Inventor: Roland Stoessel, Ebern (DE)

(73) Assignee: FTE automotive GmbH, Ebern (DE)

( * ) Notice: Subject to any disclaimer, the term of this patent is extended or adjusted under 35 U.S.C. 154(b) by 885 days.

(21) Appl. No.: 17/102,709

(22) Filed: Nov. 24, 2020

(65) Prior Publication Data

US 2021/0164558 A1 Jun. 3, 2021

(30) Foreign Application Priority Data

Dec. 2, 2019 (DE) ..... 10 2019 132 670.2
Nov. 6, 2020 (DE) ..... 10 2020 129 312.7

(51) Int. Cl.
*F04B 53/20* (2006.01)
*F04B 53/10* (2006.01)
*F04C 13/00* (2006.01)

(52) U.S. Cl.
CPC ..... *F04B 53/20* (2013.01); *F04B 53/10* (2013.01); *F04C 13/005* (2013.01)

(58) Field of Classification Search
CPC ..... F04B 53/20; F04B 2205/50; F04B 2205/501; F04B 53/10; F04B 53/1002; F04B 53/101; F04B 53/1085; F04C 13/005; F04C 15/06; F04C 2/10; F04C 2/102; F04C 14/26; F04C 15/00; F04C 29/0092; F04C 2280/00; F04C 2280/02; F04C 2280/04; F04C 2240/00; F04C 2240/80; F04C 15/0042; F04C 15/0046; F04C 15/0049; F04C 15/064; F04C 15/066; B01D 35/02;

(Continued)

(56) References Cited

U.S. PATENT DOCUMENTS 2,928,243 A * 3/1960 Albright ..... F15B 7/006 417/310
4,439,109 A * 3/1984 Wood ..... F04C 11/005 418/88

(Continued)

FOREIGN PATENT DOCUMENTS

CN 106823524 A 6/2017
CN 107387406 A 11/2017

(Continued)

OTHER PUBLICATIONS

Extended European Search Report issued Feb. 16, 2021 in European Patent Application No. 20210106.9, 7 pages.

(Continued)

*Primary Examiner* — Kenneth J Hansen
*Assistant Examiner* — Chirag Jariwala
(74) *Attorney, Agent, or Firm* — Oblon, McClelland, Maier & Neustadt, L.L.P.

(57) ABSTRACT

A liquid pump for providing a supply to a transmission of an electric or hybrid drive module of a motor vehicle, having a pump housing wherein a pump chamber and a pump rotor are arranged, wherein the pump housing has at least one intake opening, wherein a filter plate which covers at least one intake opening is attached to the pump housing.

14 Claims, 6 Drawing Sheets

(58) Field of Classification Search
CPC .. B01D 35/26; B01D 35/306; B01D 2201/16; B01D 2201/167; B01D 2201/20; B01D 2201/202; F16H 57/0436; F16H 57/0404; F16H 57/0435; F16N 39/06; F16K 15/026; F16K 2200/30; Y10T 137/8122; F04D 29/708
USPC ..... 417/313, 310, 410.3–410.5; 418/46, 47; 210/258, 416.1
See application file for complete search history.

(56) References Cited

U.S. PATENT DOCUMENTS 4,738,584 A * 4/1988 Price ..... F04D 29/426 415/203
4,938,316 A 7/1990 Ichikawa et al.
5,423,893 A * 6/1995 Kotaki ..... B01D 29/012 55/528
5,980,718 A * 11/1999 Van Konynenburg et al. ..... C02F 1/4691 204/647
6,254,354 B1 7/2001 Sonnier, Jr. et al.
6,294,375 B1 * 9/2001 Chevalier ..... C12M 23/10 435/287.9
7,156,625 B2 * 1/2007 Grant ..... F04C 15/066 417/313
10,087,932 B2 10/2018 Huang et al.
2010/0129239 A1 * 5/2010 Hadar ..... H02K 7/14 417/410.4
2014/0086763 A1 * 3/2014 Osterhaus ..... F04C 14/26 418/206.4
2014/0212310 A1 7/2014 Chumley et al.
2016/0348675 A1 12/2016 Ishii et al.
2018/0258929 A1 * 9/2018 Fischer ..... F04C 15/06
2018/0347526 A1 * 12/2018 Ito et al. ..... F04C 2/102
2019/0217227 A1 * 7/2019 Niggl et al. ..... B01D 33/23

FOREIGN PATENT DOCUMENTS

CN 108980035 A * 12/2018 ..... F04B 53/20
DE 44 23 589 C1 7/1995
JP S-61286594 A * 12/1986 ..... F04C 15/00
TW 201113430 A * 4/2011 ..... F04B 53/20

OTHER PUBLICATIONS

German Search Report issued Jul. 29, 2020 in German Application 10 2019 132 670.2 filed Dec. 2, 2019 (with English Translation of Categories of Cited Categories and Written Opinion), 6 pages.

* cited by examiner

LIQUID PUMP, IN PARTICULAR FOR PROVIDING A SUPPLY TO A TRANSMISSION OF AN ELECTRIC OR HYBRID DRIVE MODULE OF A MOTOR VEHICLE

The invention relates to a liquid pump, in particular for providing a supply to a transmission of an electric or hybrid drive module of a motor vehicle, having a pump housing in which a pump chamber and a pump rotor are arranged, wherein the pump housing has at least one intake opening.

Such a liquid pump may be used for supplying oil to a transmission or other components in a drive train. The liquid pump may, for example, be arranged on a housing of the transmission in such a way that the intake opening is arranged below the level of an oil reservoir in the transmission housing.

The object of the invention is to prevent, with little outlay, passing of impurities into the pump and possibly also to the lubrication points supplied with oil by the pump.

For the purpose of achieving said object, it is provided according to the invention, in the case of a liquid pump of the type mentioned in the introduction, that a filter plate which covers the at least one intake opening is attached to the pump housing. The invention is based on the fundamental concept of performing the filtering function with a single component which, on the one hand, can be produced with little outlay (by being provided with suitable filter openings) and which, on the other hand, can be mounted with very little outlay, specifically can be simply screwed to the housing.

Preferably, the filter plate has a multiplicity of filter openings which have an opening width of at most 0.4 mm, preferably at most 0.3 mm, and in particular at most 0.2 mm. In this way, the filtering action can be very easily set in the desired manner during the production of the filter plate.

In order to increase the overall available flow cross section, provision may additionally be made of filter slots through which oil can be sucked in. Said filter slots are provided between the filter plate and the pump housing and have dimensions which are comparable to those of the filter openings.

It is furthermore possible for the filter plate to be of planar form, if provision is made in the pump housing of recessed portions such that the filter slots are delimited between said recessed portions and the filter plate.

The filter plate may consist of a sheet metal, that is to say of a material which can be machined very well. Moreover, there is no risk of wear.

The filter plate may be etched, laser-cut or water jet-cut. By way of these machining processes, the filter openings can be produced with very high accuracy.

It is also possible for the filter plate to be a punched part, which leads to particularly low production costs.

In the case of a punched part, the filter openings may be formed between material portions of the filter plate that are bent relative to one another. This makes it possible to produce different filter plates, that is to say filter plates which differ with regard to the opening width of the filter openings, using an intrinsically identical production process. For this purpose, it is merely necessary for the material portions to be deformed relative to one another to a greater or lesser extent.

The filter plate may also be an injection-moulded part, with the result that it can be produced with little outlay, low costs and high precision.

Preferably, the filter openings are formed in an undercut-free manner, as viewed in a direction perpendicular to the plane of the filter plate. This makes it possible for the filter plate to be producible in an injection mould without slides.

According to one embodiment of the invention, it is provided that the filter plate is provided with at least one latching lug, by way of which it can be locked to the pump housing. This makes it possible for said filter plate to be pre-mounted on the pump housing such that the assembly composed of pump housing and filter plate can be checked in advance. It is thereby possible for any malfunctions to be detected before the liquid pump is completely assembled.

According to one configuration of the invention, provision is made of a pressure-limiting valve, which has a valve body and a spring, wherein the spring is supported against the filter plate. On account of its strength, the filter plate is suitable for acting as a counter bearing for the spring of the pressure-limiting valve. Consequently, no additional components are required for mounting the pressure-limiting valve.

According to one configuration of the invention, it is provided that the filter plate has a spring-centering means. This prevents inadvertent jamming of the spring during the opening and/or closing of the valve body.

The spring-centering means may be formed in particular by a plastically deformed portion of the filter plate. In this configuration too, no additional components are required. It is sufficient for the filter plate to be plastically deformed in such a way that, for the support of the spring, there is formed either a wall, in which the spring is received, or a projection, which extends into the spring.

According to the preferred embodiment of the invention, provision is made of multiple mounting screws by way of which at least one bearing body and the pump housing are screwed to one another, wherein the mounting screws have screw heads which bear directly on the filter plate. On account of its mechanical strength, the filter plate acts in the manner of shims such that separate shims can be dispensed with, which simplifies the mounting and reduces the costs.

The invention will be described below on the basis of two embodiments which are illustrated in the appended drawings. In these drawings.

Figure 1:
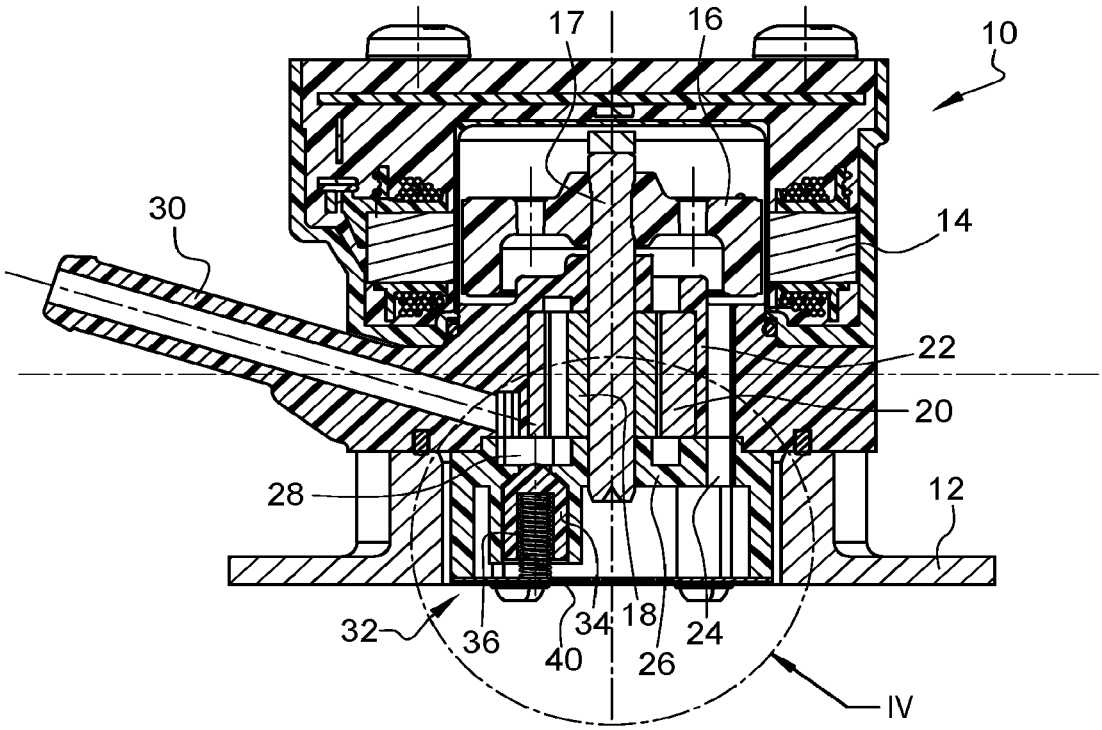
FIG. 1 shows a cross-sectional view of a liquid pump according to a first embodiment of the invention.
Figure 2:
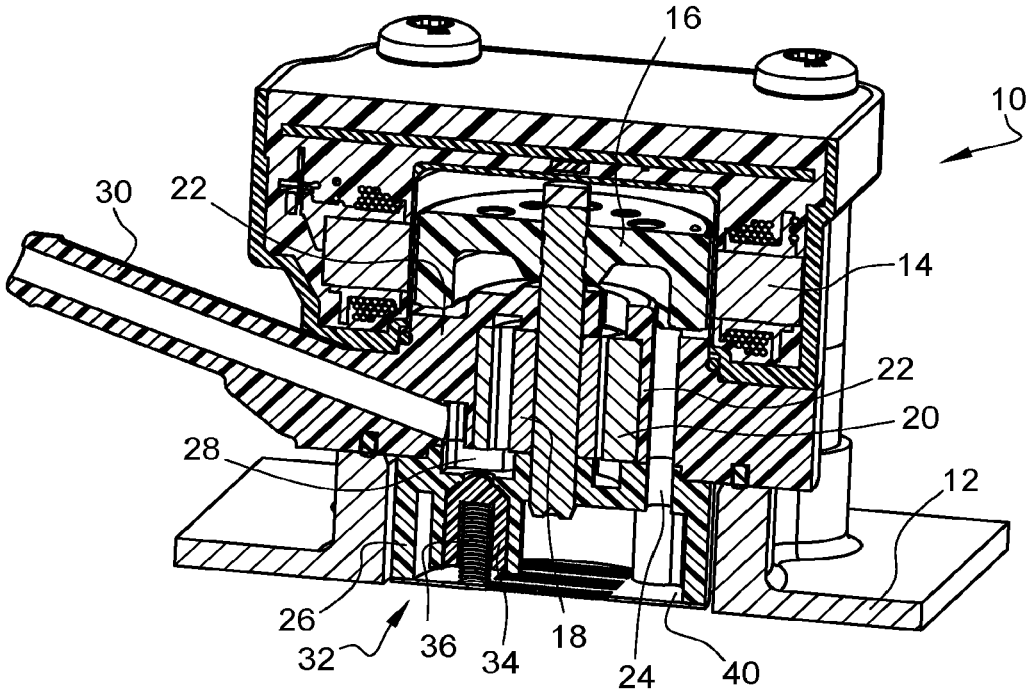
FIG. 2 shows the liquid pump in FIG. 1 in a sectioned perspective view.

FIGS. 1 and 2 show a liquid pump 10, which is provided for being attached to a transmission of an electric or hybrid drive module of a motor vehicle. Of the transmission, a part of the transmission housing 12 is schematically shown here.

The liquid pump 10 has an electric motor, which has a stator 14 and a rotor 16, wherein the rotation of the rotor 16 of the electric motor is transmitted to a pump rotor 18 by means of a shaft 17. The pump rotor 18 is part of a toothed ring pump, which has an outer ring 20 in which the pump rotor 18 meshes. The outer ring 20 slides in a pump housing 22. This pump type is also known as a gerotor pump.

The liquid pump sucks in via an intake opening 24, which is provided here in a bearing body 26 which serves for mounting the shaft 17. The discharge is realized via an outlet opening 28, which is likewise formed in the bearing body 26. From there, the oil flows to a connection piece 30.

The outlet opening 28 is assigned a pressure-limiting valve 32, which has a valve body 34 and a spring 36.

The pressure-limiting valve 32 opens if the pressure on the delivery side of the liquid pump becomes excessively high. In this case, delivered oil flows directly back to the suction side.

Here, the valve body 34 is accommodated displaceably in a suitable opening of the bearing body 26.

The spring 36 is supported against a filter plate 40, which covers the intake opening 24 at the outside and is attached to the pump housing 22. Specifically, in the embodiment shown, the filter plate 40 is attached on that side of the bearing body 26 facing away from the electric motor. Any oil which is sucked in through the intake opening 24 by the liquid pump must therefore first pass through the filter openings 42, which are provided in the filter plate 40.

The filter plate consists of sheet metal.

The filter openings may be formed by different processes according to requirements and desired accuracy. For example, the filter openings 42 may be etched, laser-cut or water jet-cut. It is also possible for the filter openings 42 to be punched.

Figure 3:
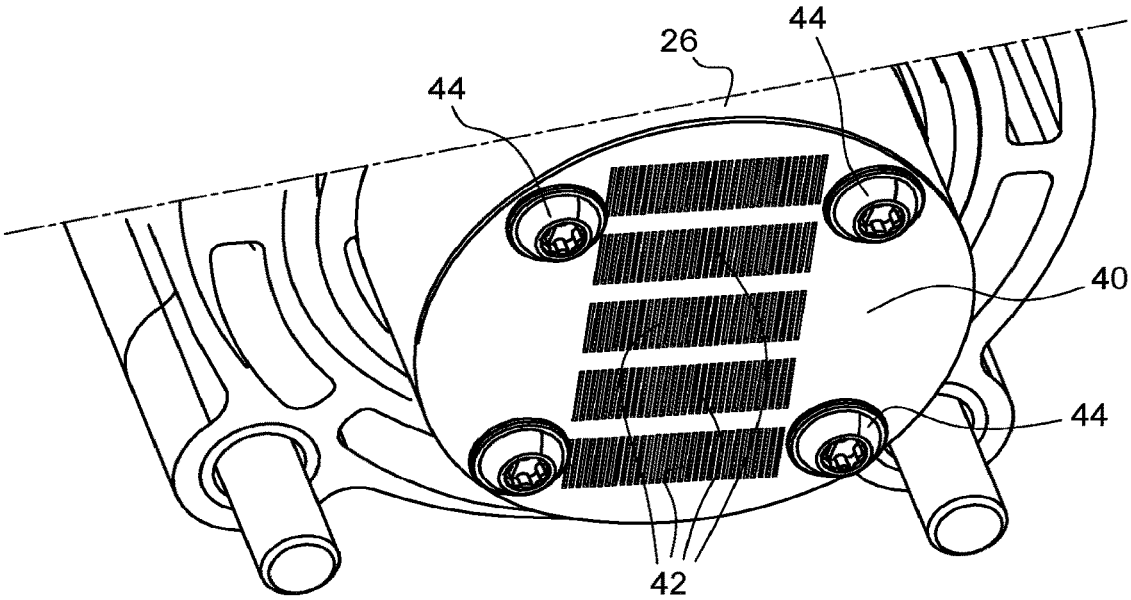
FIG. 3 shows a perspective view from below of the liquid pump in FIGS. 1 and 2.
Figure 4:
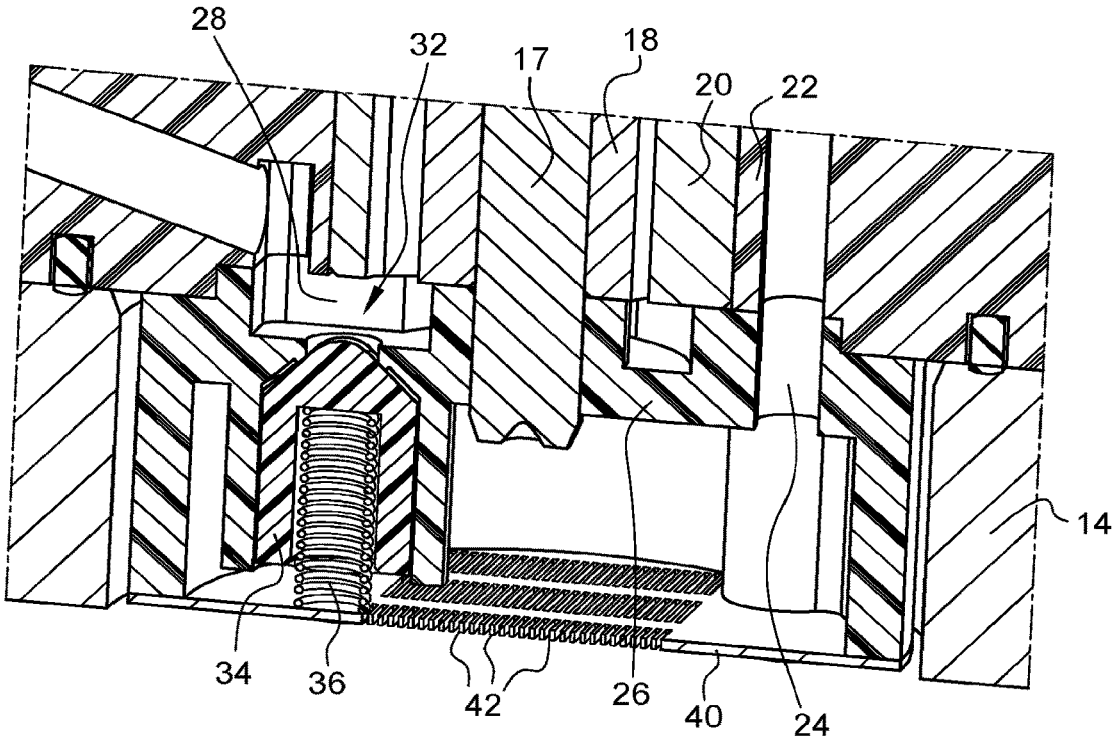
FIG. 4 shows the detail IV in FIG. 1 in a perspective view.

In order to connect the filter plate 40 to the liquid pump, multiple mounting screws 44 are provided (see in particular FIGS. 1 and 3). These extend through the filter plate 40 and the bearing body 26 at least into the pump housing 22. Since the filter plate 40 consists of metal, it has sufficient strength to serve as a "shim" for the mounting screws 44.

Figure 5:
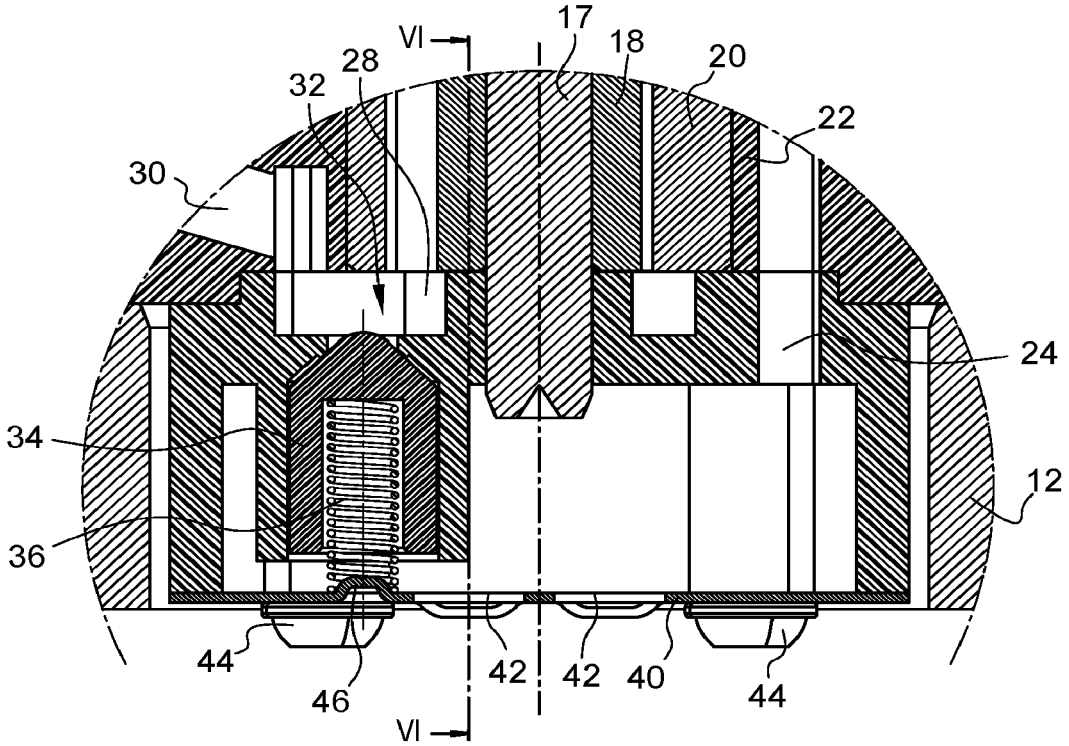
FIG. 5 shows a detail of a liquid pump according to a second embodiment in a sectional view.
Figure 6:
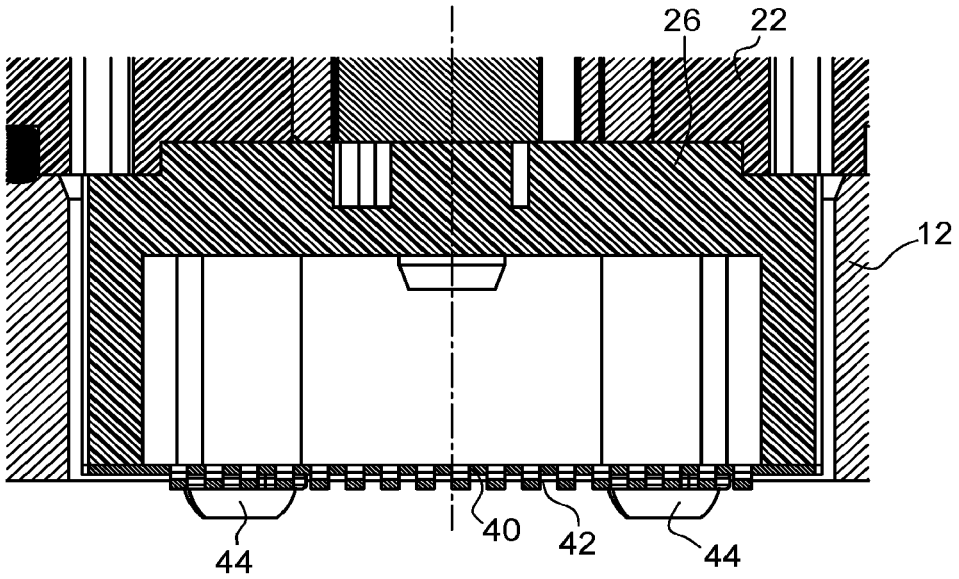
FIG. 6 shows a section along the plane VI-VI in FIG. 5.
Figure 7:
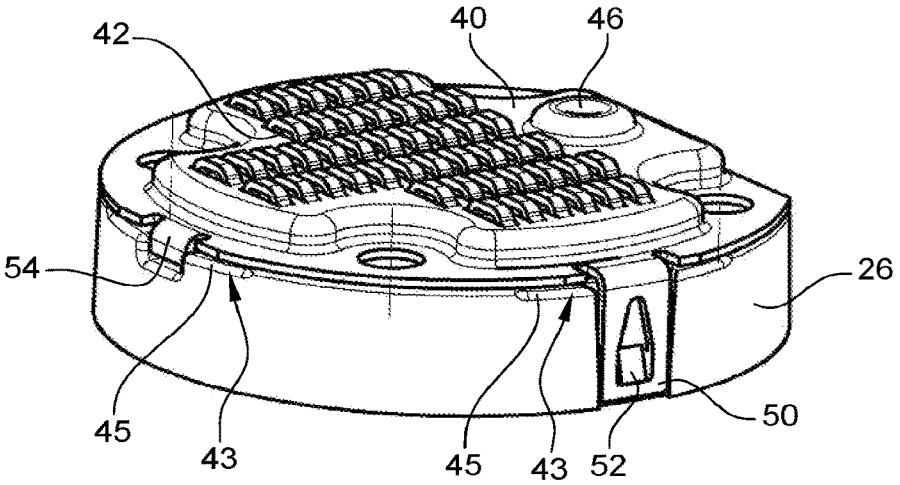
FIG. 7 shows a sub-assembly of a liquid pump according to a third embodiment in a perspective view.
Figure 8:
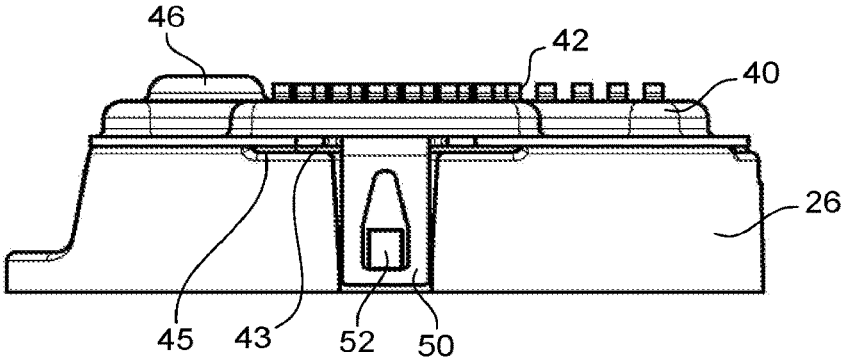
FIG. 8 shows a side view of the sub-assembly in FIG. 7.
Figure 9:
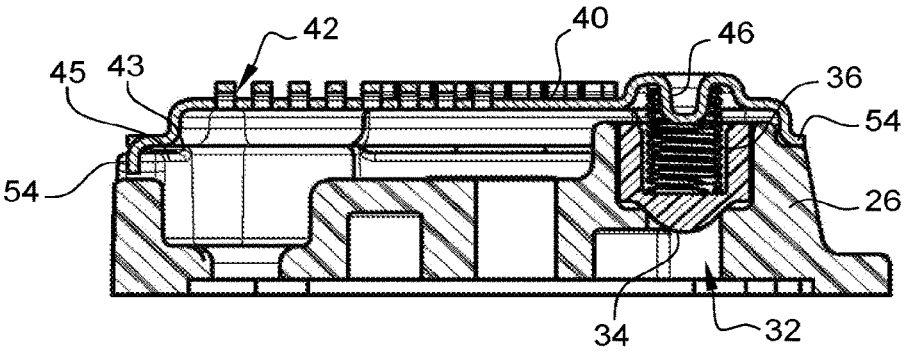
FIG. 9 shows a sectional view through the sub-assembly in FIG. 8.
Figure 10:
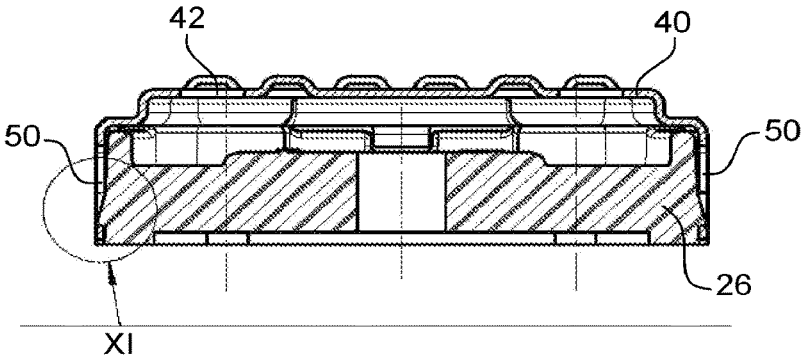
FIG. 10 shows a further sectional view through the sub-assembly in FIG. 8.
Figure 11:
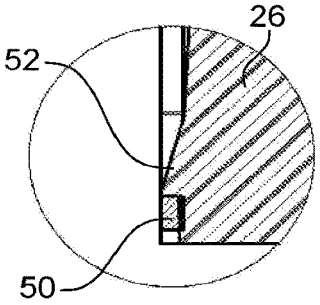
FIG. 11 shows the detail XI in FIG. 10 on an enlarged scale.

FIGS. 5 and 6 show a second embodiment. The same reference signs are used for the components known from the first embodiment, and, in this respect, reference is made to the explanations above.

The difference between the first and second embodiments lies in the configuration of the filter plate 40.

A first difference is that, in the second embodiment, a spring-centering means 46 is provided for the spring 36 of the pressure-limiting valve 32. Said spring-centering means is formed here as a projection of the filter plate 40 that is directed towards the pressure-limiting valve 32. At this position, the filter plate 40 may be deformed plastically in the manner of a deep-drawn formation.

As an alternative to the projection shown, it is also possible to use a well, that is to say a depression, in which the spring 36 is seated.

A second difference in comparison with the first embodiment is that, in the second embodiment, the filter openings 42 are formed not by cut-away regions of the material of the filter plate 40, but by plastically deformed material portions of the filter plate that are bent relative to one another (see in particular FIG. 6). This can be obtained by way of a combined punching and embossing step.

Irrespective of the manner in which the filter openings 42 are produced, the opening width of the filter openings can be set to a desired value. Said value depends on the size of dirt particles which are considered to be still permissible. Common values lie in the range from 0.2 mm to 0.4 mm.

FIGS. 7 to 11 show a sub-assembly of a liquid pump 10 according to a third embodiment. The same reference signs are used for the components known from the first two embodiments, and, in this respect, reference is made to the explanations above.

The sub-assembly shown in FIGS. 7 to 11 consists of a part of the pump housing, specifically the bearing body 26, and the filter plate 40.

As in the second embodiment, the filter plate 40 is formed from metal, and the filter openings 42 are formed by plastically deformed material portions of the filter plate 40 that are bent relative to one another.

The difference between the second and third embodiments is on the one hand that, in the third embodiment, provision is made of additional filter openings, specifically in the form of filter slots 43, which are provided between the filter plate 40 and the bearing body 26. The filter slots 43 increase the available throughflow cross section.

In order to form the filter slots 43, the bearing body is provided with multiple recessed portions 45 in the abutment surface at which the filter plate 40 bears against said bearing body (see in particular FIG. 8), with the result that, there, a flow cross section is formed between the bottom side of the filter plate 40 and the base of the recessed portions 45.

The dimensions of the filter slots correspond to the dimensions of the filter openings 42, and so the same filtering action is obtained. The recessed portions 45 are thus set back by 0.2 to 0.4 mm in comparison with the level of the abutment surface for the filter plate 40.

The difference between the second and third embodiments is on the other hand that, in the third embodiment, provision is made of multiple latching lugs 50 by way of which the filter plate 40 can be locked to the pump body.

In the exemplary embodiment shown, the latching lugs 50 are provided on the filter plate 40, and they interact with latching noses 52 on the bearing body 42.

By means of the latching lugs 50, the filter plate 40 can be pre-mounted on the pump body (on the bearing body 26 in this case) such that the sub-assembly formed in this way can be tested for proper functioning thereof. For example, the functioning of the pressure-limiting valve 32 can be tested before the liquid pump 10 is completely assembled.

Also provided on the filter plate 40 are multiple centering lugs 54, which engage into suitable cutouts in the bearing body 26. This facilitates the mounting of the filter plate 40 on the bearing body 26 and ensures that the filter plate 40, in its mounted state, is precisely in position.

Figure 12:
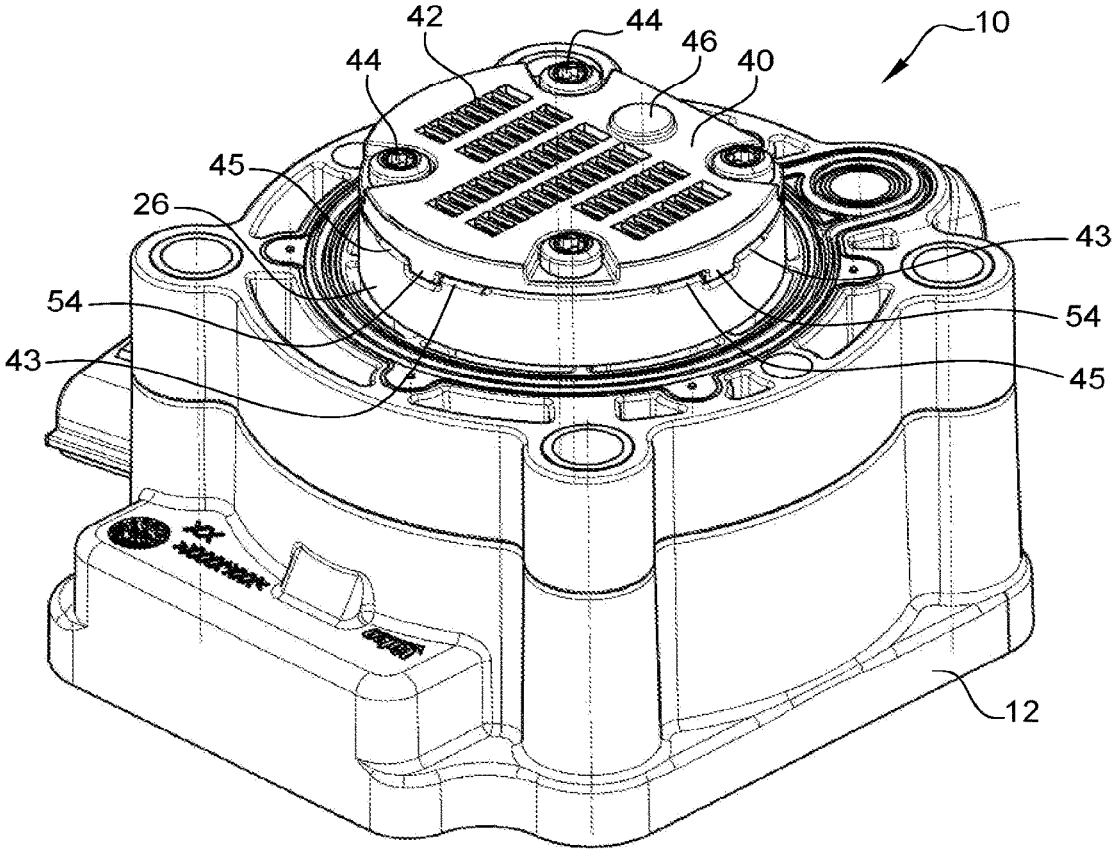
FIG. 12 shows a liquid pump according to a fourth embodiment in a perspective view.
Figure 13:
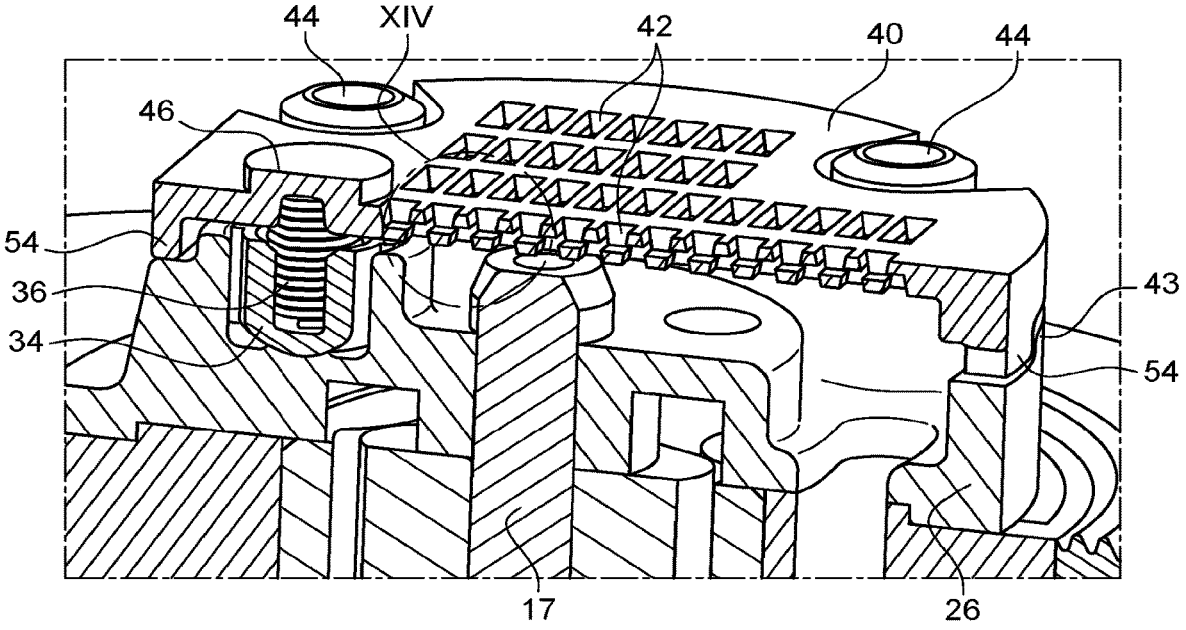
FIG. 13 shows a detail of the liquid pump in FIG. 12 in a perspective sectional view.
Figure 14:
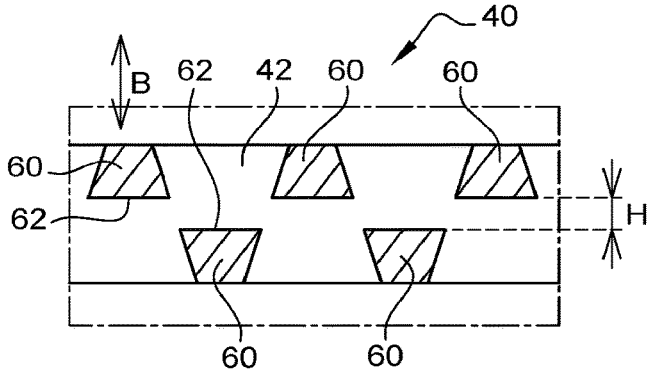
FIG. 14 schematically shows the detail XIV in FIG. 13 on an enlarged scale.

FIGS. 12 to 14 show a liquid pump according to a fourth embodiment. The same reference signs are used for the components known from the preceding embodiments, and, in this respect, reference is made to the explanations above.

The most substantial difference between the fourth embodiment and the preceding embodiments is that, in the fourth embodiment, the filter plate 40 does not consist of sheet metal, but is a plastic component.

The filter plate 40 is injection-moulded, wherein all the geometrical features (for example the spring-centering means 46 and the centering lugs 54) can be moulded. Latching lugs may also be formed, in order to be able to pre-mount the filter plate on the pump body in the same manner as in the third embodiment.

As can be seen in particular in FIG. 14, the filter plate 40 may be designed in an undercut-free manner. The filter openings 42 are formed between two layers of webs 60, which, in view of the demouldability, have a trapeziform cross section (which is illustrated in a slightly exaggerated manner here).

The mutually facing surfaces 62 of the webs 60 lie in planes which are at a distance H from one another.

The filter plate is therefore designed in an undercut-free manner (as viewed in a direction B which is perpendicular to the plane of the filter plate 40). It can therefore be injection moulded without the necessity of slides in the injection mould for this purpose. It is merely necessary that the parting surface between the two mould halves has a tooth-like engagement formation in the region of the filter openings 42.

The invention claimed is:

1. A liquid pump for providing a fluid to a transmission of an electric or hybrid drive module of a motor vehicle, comprising:

a pump housing wherein a pump chamber and a pump rotor are arranged, the pump housing has at least one intake opening;

a filter plate which covers the at least one intake opening is attached to the pump housing, the filter plate having a planar first surface which includes a plurality of filter openings formed through the planar first surface, and a pressure-limiting valve, which has a valve body and a spring, wherein the spring is in direct contact with the planar first surface of the filter plate.

2. The liquid pump according to claim 1, wherein the plurality of filter openings have an opening width of at most 0.4 mm.

3. The liquid pump according to claim 2, wherein the filter openings are formed between material portions of the filter plate that are bent relative to one another.

4. The liquid pump according to claim 2, wherein the filter plate is an injection-moulded part.

5. The liquid pump according to claim 4, wherein the filter openings do not have any undercut surfaces, as viewed in a direction perpendicular to a plane of the filter plate.

6. The liquid pump according to claim 1, wherein filter slots are provided between the filter plate and the pump housing.

7. The liquid pump according to claim 6, wherein the filter slots are formed between an inner surface of the filter plate and a recessed portion of the pump housing.

8. The liquid pump according to claim 1, wherein the filter plate consists of a sheet metal.

9. The liquid pump according to claim 1, wherein the filter plate is laser-or water jet-cut or is etched.

10. The liquid pump according to claim 1, wherein the filter plate is a punched part.

11. The liquid pump according to claim 1, wherein the filter plate has at least one latching lug, wherein the lug is configured to be locked to the pump housing.

12. The liquid pump according to claim 1, wherein the filter plate has a spring-centering means.

13. The liquid pump according to claim 12, wherein the spring-centering means is comprised of a plastically deformed portion of the filter plate.

14. The liquid pump according to claim 1, further comprising mounting screws, wherein at least one bearing body and the pump housing are screwed to one another, and wherein the mounting screws have screw heads which bear directly on the filter plate.

* * * * *